United States Patent [19]

Deister et al.

[11] 4,137,157

[45] Jan. 30, 1979

[54] SCREEN TENSION ASSEMBLY FOR VIBRATORY SCREENING APPARATUS

[75] Inventors: Emil E. Deister; Emil M. Deister, both of Fort Wayne, Ind.

[73] Assignee: Deister Machine Company, Inc., Fort Wayne, Ind.

[21] Appl. No.: 731,759

[22] Filed: Oct. 12, 1976

[51] Int. Cl.[2] ..... B07B 1/49

[52] U.S. Cl. ..... 209/403; 209/405; 209/363

[58] Field of Search ..... 209/403, 319, 405, 408, 209/363, 364; 101/127.1, 128.1, 415.1; 140/109; 160/378, 392; 52/273, 222

[56] References Cited

U.S. PATENT DOCUMENTS

| | | | |
|---|---|---|---|
| 1,484,382 | 2/1924 | Allitt | 160/392 |
| 1,717,498 | 6/1929 | Deister | 209/403 X |
| 2,190,993 | 2/1940 | Muir | 209/403 X |
| 2,345,947 | 4/1944 | Darks | 209/403 X |
| 2,825,461 | 3/1958 | Nannon | 209/403 X |
| 2,865,506 | 12/1958 | Velke | 209/403 X |
| 3,092,573 | 6/1963 | Lambert | 209/403 |
| 3,101,314 | 8/1963 | Johnson | 209/403 X |
| 3,165,110 | 1/1965 | Brooks | 52/222 |
| 3,173,523 | 3/1965 | Mote | 52/222 |
| 3,186,547 | 6/1965 | Behuke | 209/403 |
| 3,203,548 | 8/1965 | Roubal | 209/403 X |
| 3,608,720 | 9/1971 | Symons | 209/405 |
| 3,811,454 | 5/1974 | Middle | 160/395 X |
| 3,870,630 | 3/1975 | Tylinski | 209/403 |
| 3,895,468 | 7/1975 | Bernstein | 160/395 X |

FOREIGN PATENT DOCUMENTS

| | | | |
|---|---|---|---|
| 612589 | 9/1932 | Fed. Rep. of Germany | 209/403 |
| 1008257 | 5/1957 | Fed. Rep. of Germany | 209/403 |

*Primary Examiner*—Robert Halper

*Attorney, Agent, or Firm*—Gust, Irish, Jeffers & Rickert

[57] ABSTRACT

A screen tensioning assembly for vibratory, particulate material-screening apparatus of the type including a frame having spaced, parallel, upstanding side panels connected by spaced, horizontal screen support members, and two, extended area apertured screens supported on the support members and extending substantially between the side panels for separating finer from coarser material. An up-turned hook portion is formed at one side of each of the screens. Each of the screens is tensioned by a clamping member having opposite ends with one end normally engaging the respective hook portion and the other end engaging the respective side panel. Each clamping member has a pivot member secured thereto adjacent its other end, extending through an aperture in the respective side panel, and having a portion engaging the respective side panel so that the clamping member may be pivoted upwardly from the respective screen to a stored position thereby to disengage the one end thereof from the respective hook portion. Each clamping member has one end of a stud connected thereto with its other end extending through another aperture in the respective side panel. Each stud has resilient means on its other end which engages the respective side panel for urging the stud in a direction to cause the respective clamping member to apply tension on the respective screen. Each stud has a wedge removably seated in a slot in its other end which normally engages the resilient means so that removal of the wedge permits removal of the resilient means from the other end of the stud thus permitting the respective clamping member may be pivoted to its stored position. The two screens have adjacent side edges which define an elongated, narrow space therebetween intermediate and parallel with the side panels. Down-turned hook portions are respectively formed at the adjacent side edges of the screens and respectively engage upstanding elements on the support members. A member is provided which removably closes and seals the spacing against the entry of material, the closing and sealing member including an upper element which extends across and closes the space and a lower element seated in the space and having portions which respectively resiliently engage the down-turned hook portions.

19 Claims, 13 Drawing Figures

SCREEN TENSION ASSEMBLY FOR VIBRATORY SCREENING APPARATUS

BACKGROUND OF THE INVENTION

1. Field of the Invention

This invention relates generally to vibratory material-screening apparatus, and more particularly to a screen tensioning assembly for such apparatus.

2. Description of the Prior Art

Prior vibratory particulate material screening apparatus known to the present applicant has employed a screen tensioning assembly in which removal of the screen or screens required removal of threaded fasteners and disassembly of clamping and screen hold-down members. One type of such prior vibratory screen apparatus manufactured by the assignee of this application is described hereafter in connection with FIG. 1 of the drawings.

It is desirable to provide a screen hold-down and tensioning assembly for vibratory particulate material screening apparatus in which the screen or screens may be readily removed without the necessity of removing threaded fasteners and clamping and screen hold-down members.

SUMMARY OF THE INVENTION

The improved screen hold-down and tensioning assembly of the invention is adapted for use in vibratory particulate material-screening apparatus of the type which includes a frame having spaced, parallel, upstanding side panels connected by a support structure having openings therein for passing screened material therethrough. Extended area apertured screen means is provided supported on the support structure between the side panels and have opposite side edges. Means are provided for securing one side edge of the screen means to the frame and an up-turned hook portion is formed at the outer side edge. Means are provided adjacent one side panel for holding down and tensioning the screen means including a clamping member having opposite ends with one end normally engaging the hook portion and the other end normally engaging one side of the other side panel. A stud is provided having one end connected to the clamping member intermediate its ends, and its other end extending through an aperture in the one side panel. Resilient means are provided on the other end of the stud and engaging the other side of the one side panel for urging the stud in a direction to cause the clamping member to apply tension on the screen means, and means are provided for retaining the resilient means on the other end of the stud.

In accordance with the invention, means are provided on the clamping member for pivotally connecting the other end thereof to the one side panel so that the clamping member may be pivoted upwardly away from screen means to a stored position thereby to disengage the one end thereof from the hook portion. The retaining means comprises wedge means removably seated in a slot in the other end of the stud for normally engaging the resilient means whereby removal of the wedge means permits removal of the resilient means from the other end of the stud so that the clamping member may be pivoted to its stored position.

Further, in accordance with the invention, the means for securing the one side edge of the screen means to the frame comprises a down-turned hook portion formed at the one side edge of the screen means and engaging an up-standing element on the support structure, the down-turned hook portion defining a space with another element on the frame. Means are provided for removably closing and sealing against the entry of particulate material, the closing and sealing means including an upper element extending across and closing the space and a lower element seated in the space and having portions resiliently engaging the turn-downed portion and the other element. In the preferred embodiment, the screen means comprises two sections each having one side edge held-down and tensioned in accordance with the invention, the two screen sections respectively having second side edges with down-turned hook portions respectively formed thereon which define an elongated narrow space intermediate and parallel with the side panels, the down-turned hook portions respectively engaging upstanding elements on the support structure and the removable closing and sealing means of the invention closing and sealing that space.

It is accordingly an object of the invention to provide an improved screen hold-down and tensioning assembly for vibratory particulate material screening apparatus.

Another object of the invention is to provide an improved screen hold-down and tensioning assembly for vibratory particulate screening apparatus wherein the screens may be readily removed without the necessity of removing threaded fasteners and screen clamping and hold-down members.

The above-mentioned and other features and objects of this invention and the manner of attaining them will become more apparent and the invention itself will be best understood by reference to the following description of an embodiment of the invention taken in conjunction with the accompanying drawings.

DESCRIPTION OF THE PREFERRED EMBODIMENT

Figure 1:
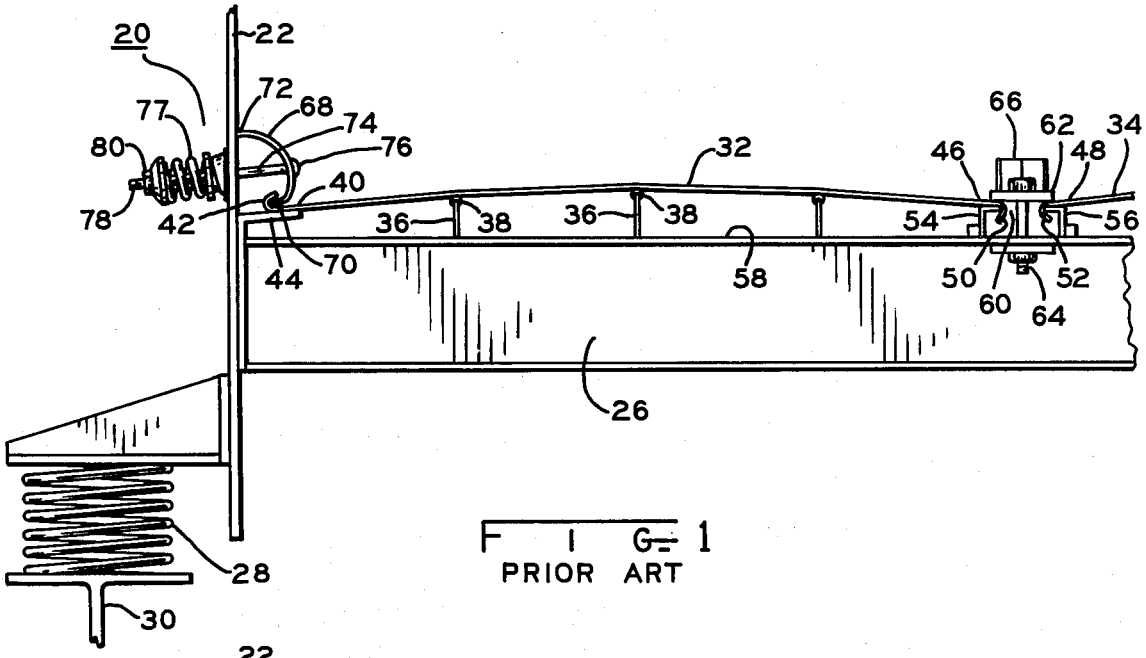
FIG. 1 PRIOR ART
FIG. 1. is a fragmentary end view of vibratory particulate material screening apparatus incorporating a prior screen hold-down and tensioning assembly.

Referring now to FIG. 1, one type of conventional vibratory particulate material screening apparatus comprises a vibratory frame, generally indicated at 20, having spaced, parallel, upstanding side panels 22, 24 (only one of which is shown in FIG. 1 at 22) which are connected by spaced, parallel, horizontal screen-support members 26 which define openings (not shown) therebetween for passing screened material therethrough. Vibratory frame 20 is supported by spring suspensions 28 on stationary frame 30 and is vibrated by suitable driving apparatus (not shown).

In one form of such prior vibratory screen apparatus, a pair of apertured screens 32, 34 are provided extending between the side panels. Screens 32, 34 are supported in a slightly upwardly arched or convex configuration by spaced support plates 36 on support members 26, each support plate 36 having a wear strip 38 thereon formed of rubber or other suitable material. Side edge 40 of screens 32, 34 have up-turned hook portions 42 formed thereon and are supported on flange members 44 extending inwardly from side panels 22, 24. Side edges 46, 48 of screens 32, 34 have down-turned hook portions 50, 52 formed thereon which respectively engage flange members 54, 56 secured to upper surface 58 of support member 26. Down-turned hook portions 50, 52 respectively define an elongated, narrow space or slot 60 parallel with and intermediate the side panels.

In one type of such prior vibratory screen apparatus, side edges 46, 48 of screens 32, 34 are held-down and space 60 is closed against the entry of particulate material by elongated center hold-down plate member 62 which is clamped in engagement with side edges 46, 48 of screens 32, 34 by threaded fasteners 64 engaging support member 26. Spaced deflector elements 66 are secured to the upper surface of hold-down member 62. It will be readily seen that in order to remove screens 32, 34, it is necessary to remove threaded fasteners 64 in order to remove hold-down member 62.

In the aforesaid prior screen hold-down and tensioning assembly, side edges 40 of screens 32, 34 are held-down and tensioned by elongated clamping plate members 68 having edges 70 engaging hook portions 42 of screens 32, 34 and edges 72 engaging the inner sides of side panels 22, 24. Studs 74 have ends 76 connected to plate members 68 intermediate their ends 70, 72 and extend through apertures (not shown) in side panels 22, 24. Springs 77 are positioned on ends 78 of studs 74 and are urged into engagement with side panels 22, 24 by threaded fasteners 80; springs 77 thus urge studs 74 in a direction to cause plate members 68 to hold-down and tension screens 32, 34. It will be readily seen that in order to remove and replace screens 32, it is necessary to remove threaded fasteners 80 and springs 77 from studs 74, and then to remove plate members 68 with studs 74 connected thereto in order to disengage hook portions 42.

Figure 2:
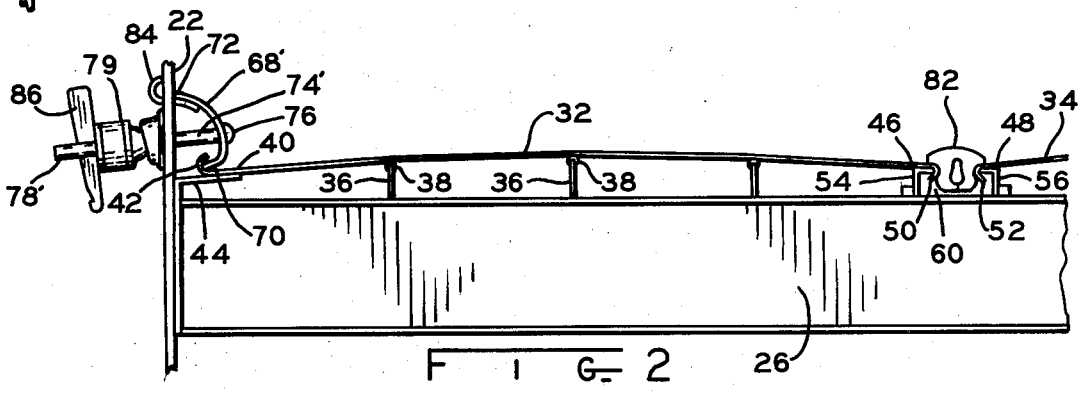
FIG. 2 is a fragmentary end view showing the improved screen hold-down and tensioning assembly of the invention.
Figure 3:
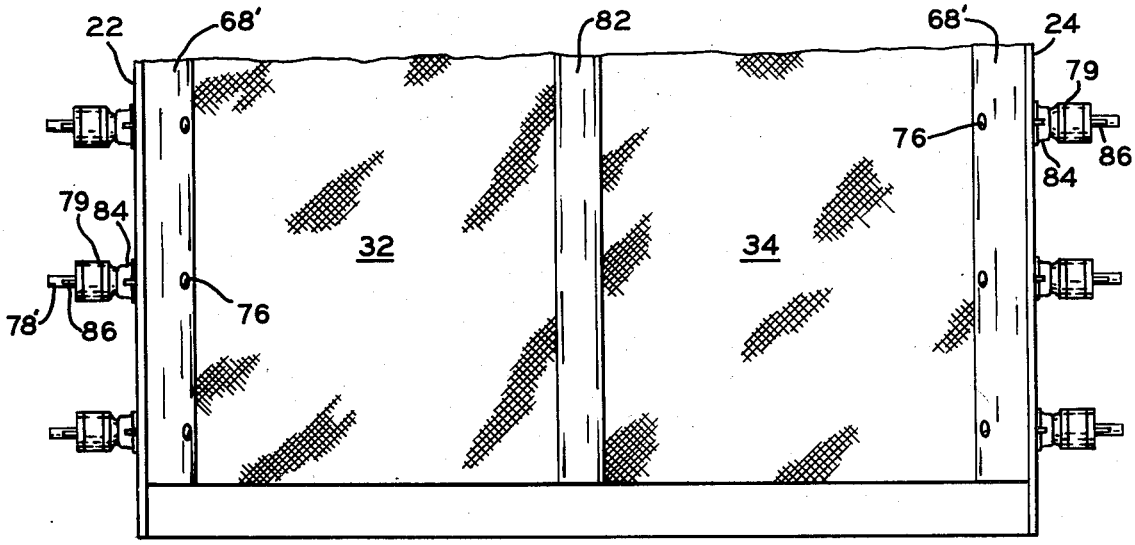
FIG. 3 is a fragmentary top view showing the improved screen hold-down and tensioning assembly of the invention.

Referring now to FIGS. 2 and 3, there is shown our improved screen hold-down and tensioning assembly, the same elements being indicated by the same reference numerals and similar elements by primed reference numerals. We have found that it is not necessary to hold-down or clamp inner side edges 46, 48 of screens 32, 34 when outer side edges 40 are properly held-down and tensioned, it being only necessary to close and seal space 60 between down-turned hook portions 50, 52. Accordingly, in accordance with the invention, space 60 is closed and sealed by member 82 which may take one of the forms shown in FIGS. 4 through 9 of the drawings and described below, none of which involve attachment by means of threaded fasteners.

In accordance with the invention, as shown in greater detail in FIGS. 10 through 12 of the drawings and described below, clamping plates 68' have spaced, relatively narrow pivot members 84 secured to end or side edges 72 which permit clamping members 68' to be pivoted upwardly away from screens 32, 34 to a stored position in which ends or side edges 70 are disengaged from up-turned hook portions 42. Resilient compression units 79 are retained on ends 78' of studs 74 by removable wedge members 86. Thus, in order to remove and replace screens 32, 34, it is only necessary to pry closing and sealing member 82 out of space 60, to remove wedges 86 and compression units 79, and to pivot clamping plates 68' to their stored positions, as best seen in FIG. 11, it being observed that removal and replacement of screens 32, 34 does not require removal of any threaded fasteners nor removal of hold-down and tensioning members.

Figure 4:
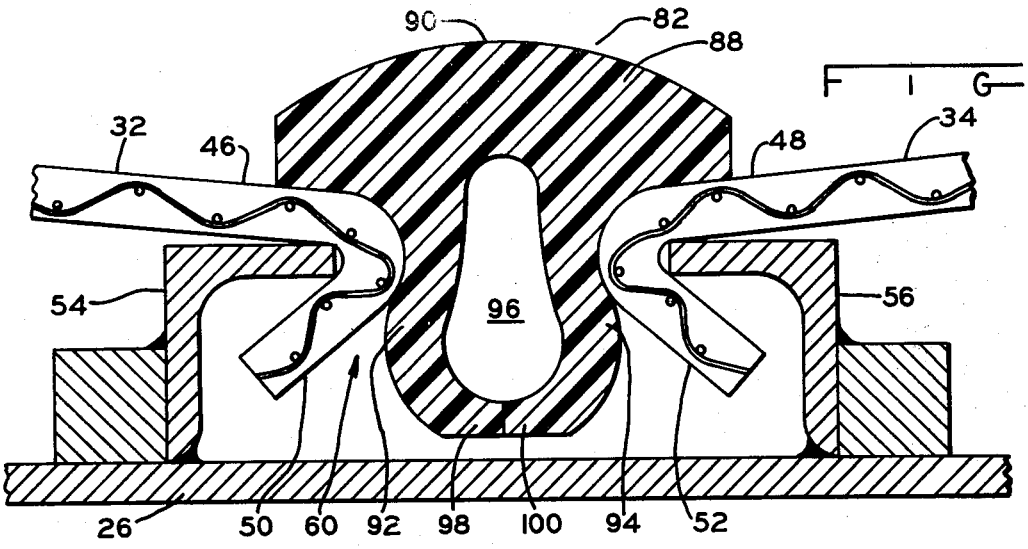
FIG. 4 is a fragmentary, cross-sectional view further illustrating the improved screen hold-down structure of the invention.
Figure 5:
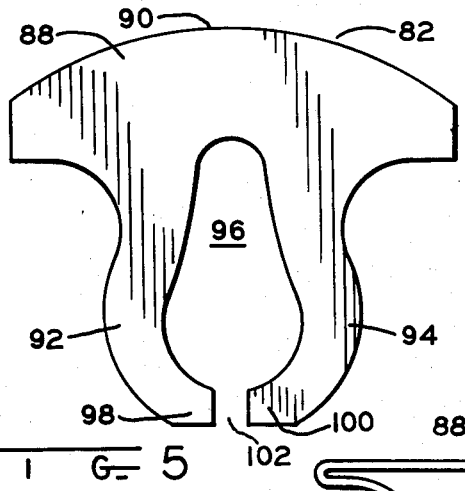
FIG. 5 is an end view of the hold-down member of FIG. 4 prior to assembly.

Referring now to FIGS. 4 and 5, in the preferred embodiment, closing and sealing member 82 comprises an elongated member formed of extruded rubber or other suitable resilient material. Member 82 has an upper closing and sealing portion 88 which extends across ends 46, 48 of screens 32, 34 and engages the same to seal opening 60. Upper portion 88 preferably has an outwardly or convexly curved outer surface 90 for deflecting particulate material onto screens 32, 34. Member 88 has integrally formed leg portions 92, 94 defining slot 96 therebetween and resiliently engaging down-turned hook portions 50, 52 of screens 32, 34 thereby holding member 82 in assembled position, as shown in FIG. 4. As shown in FIG. 5, member 82 is preferably initially extruded with lower ends 98, 100 of leg portions 92, 94 spaced-apart to define opening 102 thus providing the requisite resilience for leg portions 92, 94 to permit resilient engagement with down-turned hook portions 50, 52 of screens 32, 34.

It will be observed that member 82 cannot vibrate out of space 60 during vibratory operation of the screening apparatus by virtue of the enlarged, wedge-shaped configuration of leg portions 92, 94 which are wider, at their widest extremities, even with ends 98, 100 abutting as shown in FIG. 4, than the width of space 60. It will be seen that the somewhat wedge-shaped configuration of member 82 permits it to be driven into space 60 while the resilient characteristic of member 82 permits it to be removed from space 60 by prying with a suitable implement, such as a large screwdriver.

Figure 6:
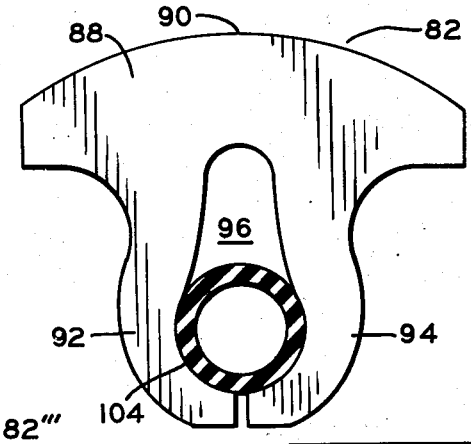
FIG. 6 is an end view showing a modification of the hold-down structure of FIGS. 4 and 5.

Referring now to FIG. 6, in which like elements are indicated by like reference numerals, if tighter engagement of leg portions 92, 94 of member 82 with turned-down hook portions 50, 52 of screens 32, 34 is desired, elongated tube 104 of rubber or other suitable material is inserted into slot 96 of member 82 thereby to spread leg portions 92, 94 causing tighter engagement with hook portions 50, 52 after assembly. It will be readily understood that the necessitity for using tube 104 depends upon the durometer of the material used for member 82; tube 104 may be needed when low durometer material is used whereas, it may not be needed with higher durometer material. It will be further be understood that element 104 may be solid rather than tubular.

Figure 7:
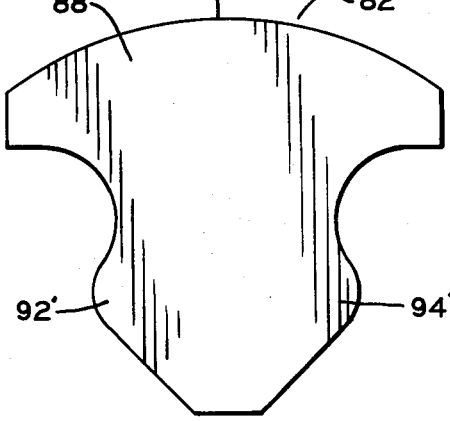
FIG. 7 is an end view showing a modification of the screen hold-down structure of the invention.

Referring now to FIG. 7, member 82′ may be formed of solid, extruded resilient material without slot 96 of the embodiment of FIGS. 4 through 6.

Figure 9:
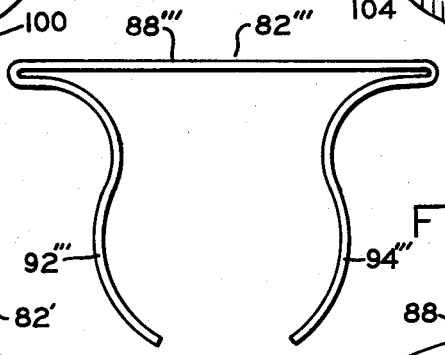
FIG. 9 is an end view showing a further modified form of screen hold-down structure.
Figure 8:
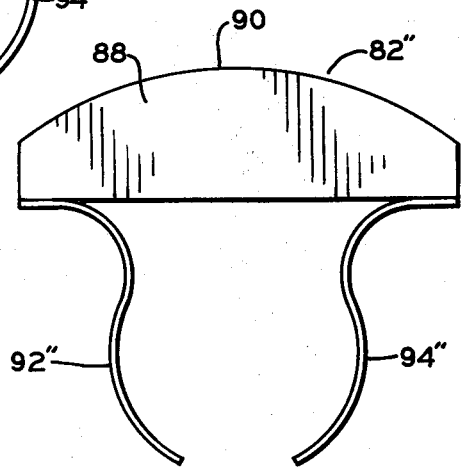
FIG. 8 is an end view showing another modified form of screen hold-down structure.

Referring to FIG. 8, member 82″ may have upper portion 88 formed of extruded, resilient material with leg portions 92″, 94″ formed of suitable spring metal, such as spring steel, adhered thereto or molded therein. Referring to FIG. 9, member 82‴ may be integrally formed of suitable spring metal, as shown.

Figure 10:
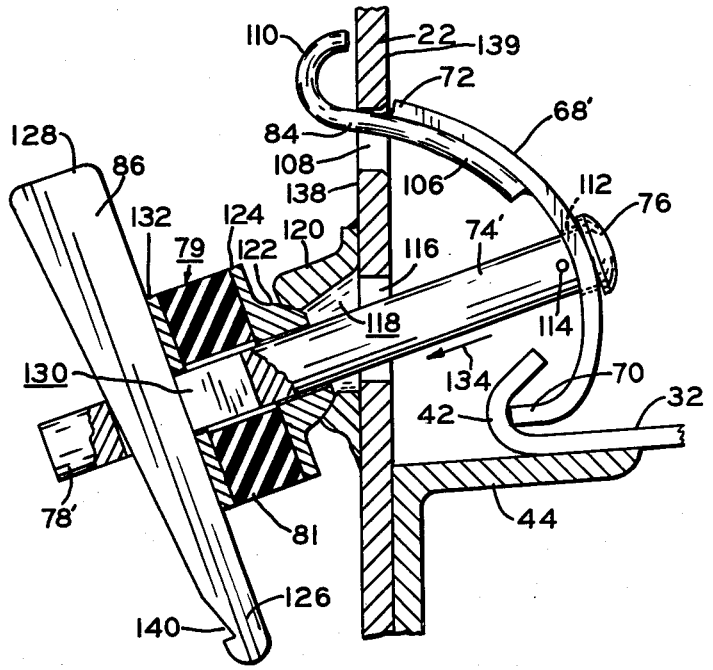
FIG. 10 is a fragmentary cross-sectional view showing one embodiment of the improved screen tensioning structure of the invention in its operative position.
Figure 11:
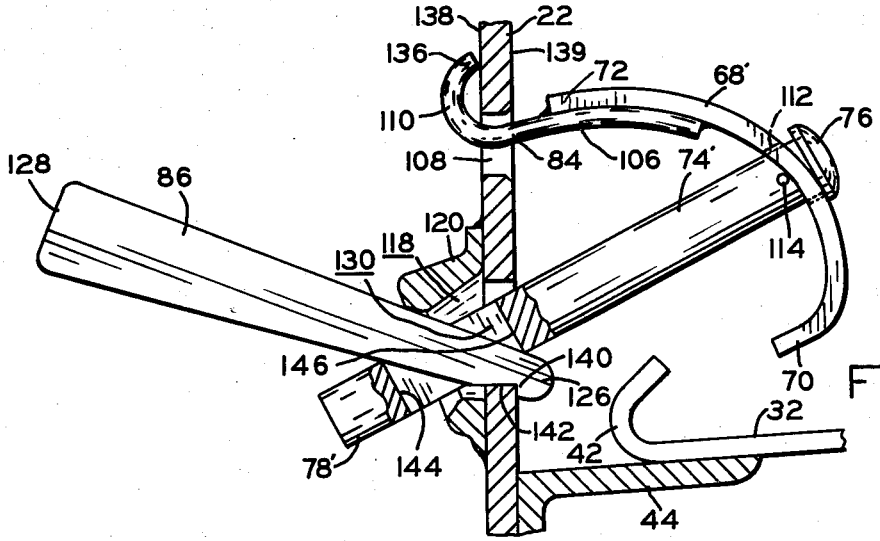
FIG. 11 is a fragmentary cross-sectional view showing the screen tensioning structure of FIG. 10 in its stored, screen-releasing position.

Referring now to FIGS. 10 and 11, each pivot member 84 comprises an elongated bar member having one end 106 secured to end 72 of clamping plate member 68′, as by welding, as shown. Member 84 extends through aperture 108 in side panel 22 and has up-turned hook portion 110 formed at its other end. Stud 74′ extends through opening 112 in clamping plate member 68′ intermediate its ends 70, 72, and head 76 thereof is held in engagement with clamping plate 68′ by pin 114. The shank of stud 74′ extends through aperture 116 in side panel 22 below aperture 108, and through opening 118 in bearing member 120 secured to the outer side 138 of side panel 22, as by welding as shown. Annular resilient compression unit 79 comprises a part-spherical bearing member 122, one-piece annular resilient member 81 formed of suitable material such as rubber or neoprene, and annular plate member 132. Bearing member 122 slidably mounted on the shank of stud 74′ engages the part-spherical socket in bearing member 120 and its integrally formed disc-shaped portion 124 is bonded to one end of resilient member 81. Wedge member 86 has small and large ends 126, 128, and is removably seated in slot 130 in end 78′ of stud 74′ engaging plate 132 which is bonded to the other end of resilient member 81.

It will be seen that unit 79 is a unitized element thus eliminating risk of dropping washers, springs, etc. It will further be seen that with wedge member 86 wedged in place, unit 79 will be in compression thus urging stud member 74′ in the direction as shown by arrow 134 thereby to urge clamping member 68′ in that direction so that its end 70 engages hook portion 42 of screen 32 and its end 72 engages inner surface 139 of side panel 22 to apply tension thereon. It will be understood that wedge 86, once driven in place, compresses unit 79 maintaining tension on screen 32 thus accommodating expansion and contraction of the screen. While use of compression units 79 is preferred, it will be understood that the coil springs 77 of FIG. 1 may be employed.

Referring now additionally to FIG. 11, in order to remove and replace screen 32, wedge 86 is driven out of slot 130 in end 78′ of stud 74′ thus permitting compression unit 79 to be removed from end 78′ of stud 74′. Hook portion 110 of pivot member 84 forms a pivot for clamping plate member 68′ permitting it to be pivoted upwardly away from screen 32 to a stored position, as shown in FIG. 11, with end 70 disengaged from hook portion 42. It will be observed that during pivoting, end 136 of hook portion 110 engages outer surface 138 of side panel 22. Wedge member 86 has notch 140 formed in its edge adjacent end 126. Notch 140 is adapted to engage edge 142 of side panel 22 which forms aperture 116 so that wedge member 86 cooperates with ends 144, 146 of slot 130 to hold stud 74′ and clamping member 68′ in the stored positio, as seen in FIG. 11.

It will now be seen that screen 32 can be removed or replaced by merely pivoting clamping member 68′ to its stored position without requiring removal of threaded fasteners and removal of the clamping member from the frame. While wedges similar to wedge members 86 have previously been used in screen tensioning assemblies, to the best of my knowledge they have no heretofore been used in conjunction with compression springs for retaining a pivoted clamping member in screen-tensioning position.

Figure 12:
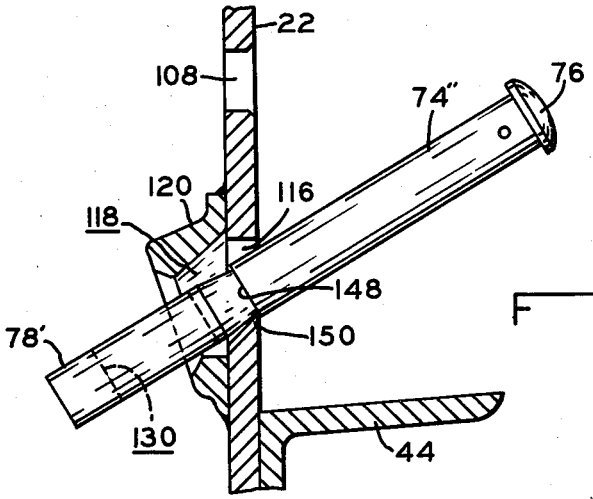
FIG. 12 is a fragmentary cross-sectional view showing a modified form of the screen-tensioning structure of the invention in its stored, screen-releasing position.

Referring now to FIG. 12, in which like elements are indicated by like reference numerals and similar elements by primed reference numerals, stud 74″ has annular shoulder 148 formed thereon which is engaged with edge 150 of opening 116 in side panel 22 thereby to hold stud 74″ and clamping member 68′ (FIG. 11) in the open, stored position.

Figure 13:
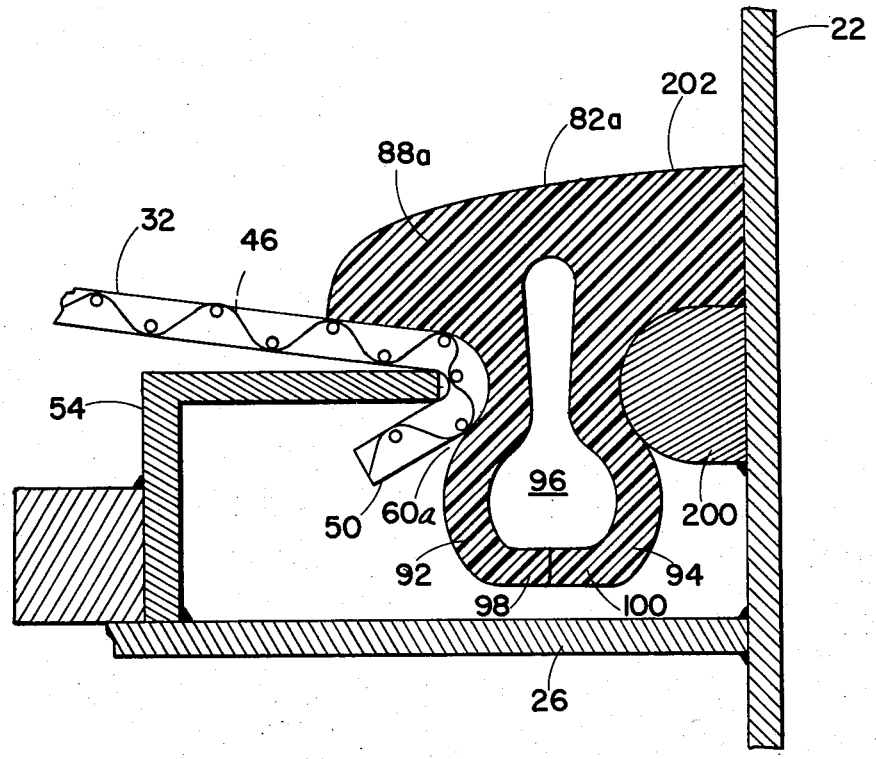
FIG. 13 is a fragmentary, cross-sectional view of another embodiment of the invention.

FIG. 13 illustrates another embodiment of this invention. Like numerals indicate like parts and similar parts have the same reference numerals with the suffix "*a*" added. In this embodiment, the slot 60*a* is disposed between flange member 54 and one side panel 22. The screen 32 having a down-turned hook portion 50 engaged with the flange 54 is stretched toward the other side panel 22 and is suitably secured into place, for example, by means of clamping plates 68 or 68′ and the associated assembly as shown in FIGS. 1 and 2. A closing and sealing member 82*a* formed substantially the same as member 82 of FIGS. 4 and 5 is inserted in the slot 60*a*, this slot being defined between the down-turned hook portion 50 of screen 32 and a half-round bar 200 welded to the inside of the side panel 22. The bar 200 extends parallel to the flange 54 but is spaced therefrom as shown.

The closing and sealing portion 88*a* of the member 82*a* is formed differently than the counterpart portion of member 82 (FIGS. 4 and 5) in that the upper surface 202 thereof is inclined upwardly and away from the screen 32 to a point of engagement with the side panel 22. Thus, particulate material can gravitate down the sloped surface 202 and onto the screen 32.

Other closing and sealing members according to the embodiments of FIGS. 6–8 may be used instead of the particular member 82*a* so long as the upper surface thereof is sloped like surface 202. While a particular slope is shown in the drawings, it is to be understood that the shape of the surface may vary so long as it inclines downwardly toward screen 32 so as to divert any particulate material thereon toward the screen 32.

In other respects, the closing and sealing member 82*a* conforms to the structure and function described in connection with FIGS. 4 and 5 as well as the other embodiments of FIGS. 6–8.

While there have been described above the principles of this invention in connection with specific apparatus, it is to be clearly understood that this description is made only by way of example and not as a limitation to the scope of the invention.

What is claimed is:

1. In particulate material-screening apparatus including a frame having spaced, parallel, upstanding side panels connected by a support structure having openings therein for passing screened material therethrough, extended area apertured screen means supported on said support structure between said side panels for separating finer from coarser material and having opposite side edges, means for securing one side edge of said screen means to said frame, an up-turned hook portion formed at the other side edge of said screen means, and means adjacent one side panel for holding down and tensioning said screen means including a clamping member having opposite ends with one end directly engaging said hook portion and the other end engaging said one side panel, a stud having one end connected to said clamping member to move the latter in opposite directions by corresponding movement of said stud, said stud extending through an aperture in said one side panel, resilient means on said other end of said stud and engaging said one side panel for urging said stud in a direction to cause said clamping member to apply tension on said screen means, and means for retaining said resilient means on said other end of said stud, means on said clamping member for pivotally connecting said other end thereof to said one side panel so that said clamping member may be pivoted upwardly away from said screen means to a stored position thereby to disengage said one end of said hook portion, said retaining means comprising wedge means removably seated in a slot in said other end of said stud for normally engaging and compressing said resilient means with said one end of said clamping member directly engaged with said hook portion of said screen means whereby removal of said wedge means permits removal of said resilient means from said other end of said stud so that said clamping member may be pivoted to said stored position.

2. The apparatus of claim 1 wherein said one side panel has another aperture therein spaced above said first-named aperture, said pivotal connecting means comprising an extension portion formed on said other end of said clamping member, said extension portion removably extending through said other aperture and having means thereon cooperating with said one side panel for pivoting said clamping member.

3. The apparatus of claim 2 wherein said pivoting means comprises an up-turned hook portion having a distal end which engages said one side panel during said pivoting of said clamping member.

4. The apparatus of claim 3 wherein said clamping member comprises an elongated plate with said ends being the side edges thereof, said plate being convexly curved between said side edges, said extension portion comprising an elongated member having one end secured to said plate adjacent the side edge thereof corresponding to said other end and extending outwardly therefrom, said last-named hook portion being formed at the other end of said elongated member.

5. The apparatus of claim 1 wherein said wedge means comprises an elongated wedge member having smaller and larger ends, said wedge member having a notch formed in one edge thereof adjacent said smaller end and adapted to engage an edge of said one side panel which defines said aperture so that said wedge member cooperates with the ends of said slot to retain said stud and clamping member in said stored position.

6. The apparatus of claim 1 wherein said stud has a shoulder formed thereon adapted to engage an edge of said one side panel which defines said aperture thereby to retain said stud and clamping member in said stored position.

7. The apparatus of claim 1 wherein said resilient means comprises a unitary compression member formed of resilient material and having opposite ends, a plate member bonded to one end of said compression member and normally engaged by said wedge means, a first bearing member having a bearing portion and a portion bonded to the other end of said compression member, and another bearing member having a bearing portion cooperating with said first named bearing portion and a portion secured to said one side panel.

8. The apparatus of claim 1 wherein said securing means comprises a down-turned hook portion formed at said one side edge of said screen means and engaging an upstanding element on said support structure, said last-named hook portion defining a space with another element on said frame, and further comprising means for removably closing and sealing said space against the entry of said material, said closing and sealing means including an upper element extending across and closing said space and a lower element seated in said space and having portions resiliently engaging said last-named hook portion and said other element.

9. The apparatus of claim 8 wherein said closing and sealing means is integrally formed of resilient material.

10. The apparatus of claim 8 wherein said lower element includes a pair of leg portions respectively resiliently engaging said last-named hook portion and other element.

11. The apparatus of claim 10 wherein said upper and lower respectively formed of spring metal.

12. The apparatus of claim 10 wherein said upper and lower elements comprise an integral member formed of resilient material, said leg portions defining a slot therebetween.

13. The apparatus of claim 12 further comprising an element seated in said slot and urging said leg portions outwardly into engagement with said last-named hook portion and other element.

14. The apparatus of claim 13 wherein said last-named element is a hollow tube formed of resilient material.

15. The apparatus of claim 8 wherein said upper element has an upper surface which is upwardly convexly curved.

16. The apparatus of claim 8 wherein said lower element is generally wedge-shaped.

17. The apparatus of claim 1 wherein said screen means comprises two sections respectively having adjacent side edges defining an elongated, narrow space therebetween intermediate and parallel with said side panels, down-turned hook portions at said adjacent side edges respectively engaging upstanding elements on said support structure, and further comprising means for removably closing and sealing said space against the entry of said material, said closing and sealing means including an upper element extending across and closing said space, and a lower element seated in said space and having portions respectively resiliently engaging said last-named hook portions.

18. In particulate material-screening apparatus including a frame having spaced, parallel, upstanding side panels connected by a support structure having openings therein for passing screened material, two extended area apertured screens supported on said panels for separating finer from coarser material and respectively having opposite side edges, means for securing one side edge of each said screen to said frame adjacent a respective side panel, the other side edges of said screens being adjacent and defining an elongated, narrow space therebetween intermediate and parallel with said side panels, and down-turned hook portions respectively formed at said other side edges and respectively engaging upstanding elements on said support structure; the improvement comprising means for removably closing and sealing said space against the entry of said material, said closing and sealing means including an upper element extending across and closing said space, and a lower element seated in said space and having portions respectively resiliently engaging said last-named hook portions, each of said securing means comprising an up-turned hook portion formed at the one side edge of the respective screen, each of said securing means comprising a clamping member having opposite ends with one end normally engaging the respective up-turned hook portion and the other end normally engaging the respective side panel, a stud having one end connected to said clamping member intermediate said ends thereof and its other end extending through an aperture in the respective side panel, resilient means on said other end of said stud and engaging the respective side panel for urging said stud in a direction to cause said clamping member to apply tension on the respective screen, means on said clamping member for pivotally connecting said other end thereof to the respective side panel so that said clamping member may be pivoted upwardly away from the respective screen to a stored position thereby to disengage said other end from the respective hook portion, and wedge means removably seated in a slot in said other end of said stud and normally engaging and compressing said resilient means whereby removal of said wedge means permits removal of said resilient means from said other end of said stud so that said clamping member may be pivoted to said stored position.

19. The apparatus of claim 18 wherein each of said resilient means comprises a unitary compression member formed of resilient material and having opposite ends, a plate member bonded to one end of said compression member and normally engaged by said wedge means, first a bearing member having a bearing portion and a portion bonded to the other end of said compression member, and another bearing member having a bearing portion cooperating with said first named bearing portion and a portion secured to said one side panel and a portion secured to the respective side panel.

* * * * *

UNITED STATES PATENT AND TRADEMARK OFFICE

CERTIFICATE OF CORRECTION

PATENT NO. : 4,137,157

DATED : January 30, 1979

INVENTOR(S) : Emil E. Deister, Emil Mark Deister

It is certified that error appears in the above-identified patent and that said Letters Patent are hereby corrected as shown below:

Col. 1, line 39, "outer" should be --other--.
Col. 2, line 4, after "sealing" insert --that space--.
Col. 5, line 68, "positio" should be --position--.
Col. 6, line 7, "no" should be --not--.

Claim 1, col. 7, line 19, "of" should be --for--.

Signed and Sealed this

*Second* Day of *October 1979*

[SEAL]

*Attest:*

RUTH C. MASON
*Attesting Officer*

LUTRELLE F. PARKER
*Acting Commissioner of Patents and Trademarks*